US006911953B2

(12) United States Patent
Gothard et al.

(10) Patent No.: US 6,911,953 B2
(45) Date of Patent: Jun. 28, 2005

(54) MULTI-BAND RING FOCUS ANTENNA SYSTEM WITH CO-LOCATED MAIN REFLECTORS

(75) Inventors: Griffin K. Gothard, Satellite Beach, FL (US); Timothy E. Durham, Palm Bay, FL (US); Jay A. Kralovec, Melbourne, FL (US); Sean C. Ortiz, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 26 days.

(21) Appl. No.: 10/703,253

(22) Filed: Nov. 7, 2003

(65) Prior Publication Data

US 2005/0099350 A1 May 12, 2005

(51) Int. Cl.[7] ..... H01Q 19/19; H01Q 1/28; H01Q 13/00

(52) U.S. Cl. ..... 343/781 CA; 343/781 P; 343/779

(58) Field of Search ..... 343/779, 786, 343/781 P, 781 CA

(56) References Cited

U.S. PATENT DOCUMENTS 4,544,928 A * 10/1985 Afifi et al. ..... 343/781 P
5,907,309 A 5/1999 Anderson et al.
6,211,834 B1 * 4/2001 Durham et al. ..... 343/781 P
6,323,819 B1 * 11/2001 Ergene ..... 343/786
6,697,028 B1 * 2/2004 Gothard et al. ..... 343/781 CA
6,720,932 B1 * 4/2004 Flynn et al. ..... 343/786
6,831,613 B1 * 12/2004 Gothard et al. ..... 343/779

FOREIGN PATENT DOCUMENTS

CA 1 191 944 8/1985

OTHER PUBLICATIONS

U.S. Appl. No. 10/231,933, filed Aug. 29, 2002, Gothard, et al.

U.S. Appl. No. 10/600,627, filed Jun. 20, 2003, Gothard, et al.

* cited by examiner

*Primary Examiner*—Tuyet Vo
*Assistant Examiner*—Hung Tran Vy
(74) *Attorney, Agent, or Firm*—Sacco & Associates, PA

(57) ABSTRACT

A compact multi-band ring-focus antenna system. The antenna system includes a first and a second main reflector 304, 306, each having a shaped surface of revolution about a common boresight axis (322) of the antenna. A first backfire type RF feed system (302, 312) is provided for feeding the first main reflector (304) on a first frequency band. A second RF feed (301) coaxial with the first RF feed (300) is provided for feeding the second main reflector (306) on a second frequency band spectrally offset from the first frequency band. Further a portion of the second RF feed passes through a first sub-reflectors (302) of the backfire feed. The second RF feed is terminated a distance from the first sub-reflector to illuminate a second sub-reflector (303).

20 Claims, 5 Drawing Sheets

MULTI-BAND RING FOCUS ANTENNA SYSTEM WITH CO-LOCATED MAIN REFLECTORS

BACKGROUND OF THE INVENTION

1. Statement of the Technical Field

The inventive arrangements relate generally to methods and apparatus for antennas and feed systems, and more particularly to ring focus antennas and feed systems that can operate in multiple frequency bands.

2. Description of the Related Art

It is desirable for microwave satellite communication antennas to have the ability to operate on multiple frequency bands. Upgrading existing equipment to such dual band capability without substantially changing antenna packaging constraints can be challenging. For example, there can be existing radomes that impose spatial limitations and constraints on the size of the reflector dish. The existing antenna location and packaging can also limit the dimensions of the antenna feed system. For example, the existing radome can limit the forward placement of the feedhorn and the sub-reflectors. Similarly, modifications to the existing opening in the main reflector are preferably avoided. As a result, for small aperture reflectors, the feed horn and the sub-reflectors must fit in a relatively small cylinder.

In view of these spatial limitations, special techniques must be used to maintain antenna efficiency. U.S. Pat. No. 6,211,834 B1 to Durham et al. (hereinafter Durham), concerns a multi-band shaped ring focus antenna. In Durham, a pair of interchangeable, diversely shaped close proximity-coupled sub-reflector-feed pairs are used for operation at respectively different spectral frequency bands. Swapping out the subreflector/feed pairs changes the operational band of the antenna. Advantage is gained by placement of the shaped sub-reflectors in close proximity to the feed horn. This reduces the necessary diameter of the main shaped reflector relative to a conventional dual reflector antenna of the conventional Cassegrain or Gregorian variety. The foregoing arrangement of the feed horn in close proximity to the sub-reflector is referred to as a coupled configuration.

The coupled configuration described in Durham generally involves sub-reflectors to feed horn spacing on the order of two wavelengths or less. This is in marked contrast to the more conventional sub-reflector to feed horn spacing used in a decoupled configuration that is typically on the order of several to tens of wavelengths.

Although Durham demonstrates how a ring focus antenna may operate at different spectral bands, sub-reflector-feed pairs must be swapped each time the operational band of the antenna is to be changed. Accordingly, that system does not offer concurrent operation on spectrally offset frequency bands.

U.S. Pat. No. 5,907,309 to Anderson et al. and U.S. Pat. No. 6,323,819 to Ergene each disclose dual band multimode coaxial antenna feeds that have an inner and outer coaxial waveguide sections. However, neither of these systems solve the problem associated with implementing dual band reflector antennas in very compact antenna packaging configurations.

SUMMARY OF THE INVENTION

The invention concerns a compact multi-band ring-focus antenna system. The antenna system includes a first and a second main reflector, each having a shaped surface of revolution about a common boresight axis of the antenna. A first backfire type RF feed is provided for feeding the first main reflector on a first frequency band. A second RF feed coaxial with the first RF feed is provided for feeding the second main reflector on a second frequency band spectrally offset from the first frequency band. Further a portion of the second RF feed passes through a first sub-reflector of the backfire feed. The second RF feed is terminated a distance from the first sub-reflector to illuminate a second sub-reflectors.

According to one aspect of the invention, t at least a portion of the first main reflector can be substantially co-located with the second main reflector. For example, the colocated portion of the first main reflector can be located at an inner periphery of the main reflector closest to the boresight axis. Further, the first main reflector can advantageously be formed as a frequency selective surface (FSS).

The backfire feed is comprised of a first horn closely coupled to and directly interacting with the first sub-reflector. The first horn and the first sub-reflector together comprise a circular to radial waveguide transition section of the backfire feed. In contrast, the second RF feed is decoupled from the second sub-reflector. For example, a vertex of the second sub-reflector can be spaced along the boresight axis at least about four wavelengths from a vertex of the first sub-reflector According to one aspect of the invention, at least one of the first and second main reflector has no continuous surface portion thereof shaped as a regular conical surface of revolution. According to another aspect of the invention, the second sub-reflector can be formed so as to have no continuous surface portion thereof shaped as a regular conical surface of revolution.

DETAILED DESCRIPTION OF THE INVENTION

Figure 1:
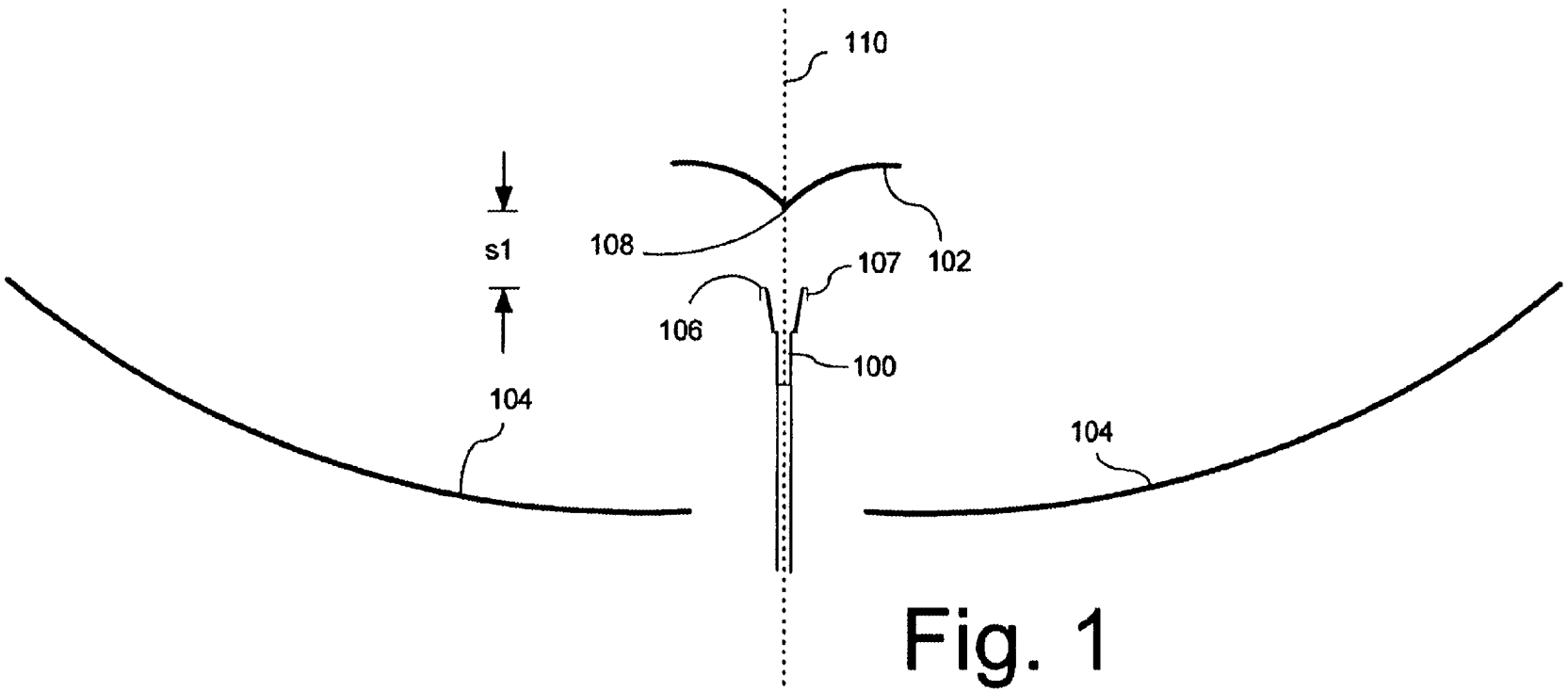
Fig. 1 (Prior Art)
FIG. 1 is a schematic representation of a decoupled ring-focus reflector antenna design that is useful for understanding the invention.

Ring focus antenna architectures commonly make use of a dual reflector system as shown in FIG. 1. With the dual reflector system, an RF feed 100 illuminates a sub-reflector 102, which in turn illuminates the main reflector 104. RF feed 100 can be a simple conical horn arrangement or can include one or more additional features such as an RF chokes 107 to improve performance. For example, the introduction of the choke can improve the gain factor and spillover efficiency. Sub-reflector 102 and main reflector 104 are shaped surfaces of revolution about a boresight axis 110 and are suitable for reflecting RF energy. The arrangement of the feed horn and sub-reflector in FIG. 1 is referred to as a decoupled configuration or a decoupled feed/subreflector antenna.

In a decoupled feed/subreflector antenna, the RF feed 100 is located in the approximate far field of the sub-reflector 102. For example, the aperture 106 of the RF feed 100 can be positioned spaced from a vertex 108 of the sub-reflector 102 by a distance at the frequency of interest, where s1 is greater than or equal to about four wavelengths. Since the RF feed is in the approximate far-field, the decoupled feed/subreflector configuration lends itself to optical design techniques such as ray tracing, geometrical theory of diffraction (GTD) and so on.

Figure 2:
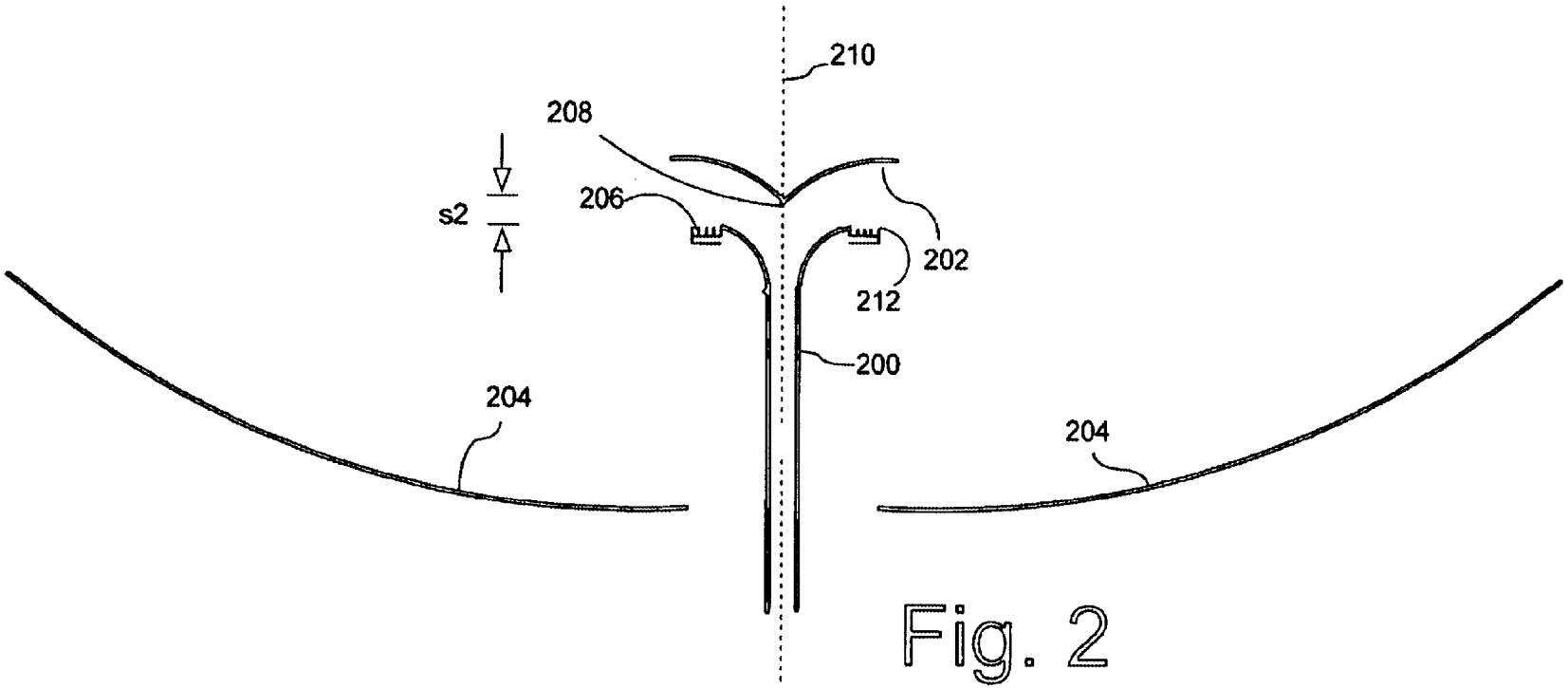
Fig. 2 (Prior Art)
FIG. 2 is a schematic representation of a coupled-feed ring-focus reflector antenna design that is useful for understanding the invention.

A second known type of ring focus antenna system illustrated in FIG. 2 is known as a coupled-feed/sub-reflector antenna. Similar to the antenna in FIG. 1, this type of antenna makes use of a sub-reflector 202 and main reflector 204 that are shaped surfaces of revolution about a boresight axis 210 and are suitable for reflecting RF energy. In this type of antenna, the RF feed 200 and the sub-reflector 202 are spaced more closely as compared to the decoupled configuration. The RF feed 200 can include one or more RF chokes 212 at an aperture 206 of the RF feed. The purpose of the chokes is to improve antenna pattern performance with respect to sidelobes. For example, such RF chokes can be used to meet a particular set of sidelobe specification curves and/or improve return loss matching. The aperture 206 of the RF feed and the vertex 208 of the sub-reflector 202 can be spaced apart by a distance s2 that is typically less than about 2 wavelengths at the frequency of interest. When arranged in this way, the RF feed 200 and the sub-reflector 202 are said to be coupled in the near-field to generate what is commonly known as a "back-fire" feed.

According to a preferred embodiment, the diameter of the focal ring of the main reflector 204 and the diameter of the sub-reflector 202 at the aperture are advantageously selected to be about the same size. If they are not, the coupled feed focal ring will not be coincident with the focal ring defined by the main reflector 204. Further, the diameter of the subreflector 202 is preferably not much larger than the diameter of RF feed 200 at the aperture.

In a back-fire feed configuration, the RF feed 200 and the sub-reflector 202 in combination can be considered as forming a single integrated feed network. This single feed network is particularly noteworthy as it provides a circular to radial waveguide transition that generates a prime-ring-focus type feed for the main reflector 204. In this regard, the back-fire feed can be thought of as being similar to a prime-focus parabolic feed. The circular to radial waveguide transition is produced by the interaction of the horn portion of the RF feed 200 with the subreflector 202. Further, those skilled in the art will appreciate that the sub-reflector 202 in this feed configuration is not truly operating as a reflector in the conventional sense but rather as a splash-plate directly interacting with the feed aperture 206.

The ring focus antennas in FIGS. 1 and 2 can employ a conventional geometry or may use shaped-geometry main reflector and a shaped-geometry sub-reflector feed similar to the arrangement described in U.S. Pat. No. 6,211,834 B1 to Durham et al., the disclosure of which is incorporated herein by reference. In Durham et al., interchangeable, diversely shaped close proximity-coupled sub-reflector/feed pairs are used with a single multi-band main reflector for operation at respectively different spectral frequency bands. Swapping out the sub-reflector/feed pairs changes the operational band of the antenna. Each of the main reflector and the sub-reflector in the system described in Durham et al. are respectively shaped as a distorted or non-regular paraboloid and a distorted or non-regular ellipsoid.

Figure 3:
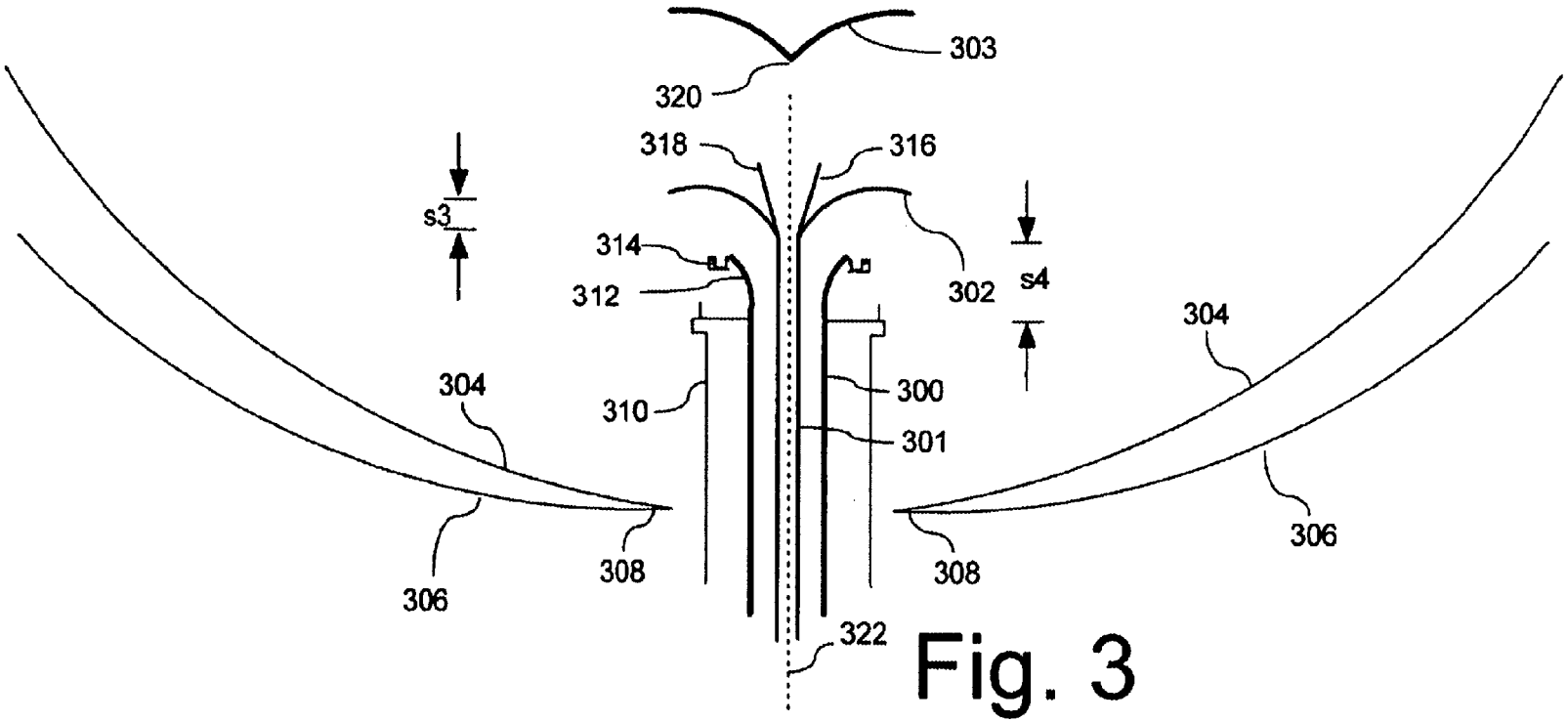
FIG. 3 is a schematic representation of a hybrid antenna system that combines the features of the antennas in FIGS. 1 and 2.

The present invention combines the concept of the decoupled feed/subreflector antenna in FIG. 1 and backfire type coupled feed/subreflector antenna in FIG. 2 to provide multi-band capability in a very compact design. Ring focus antennas using the coupled configuration concept shown in FIG. 2 tend to be more compact as compared to other comparably performing dual reflector antennas. Accordingly, two independent ring-focus reflector geometries can be located in approximately the same swept volume as a single Cassegrain or Gregorian system As shown in FIG. 3, a pair of co-located first and second main reflectors 304, 306 can be used concurrently with first and second RF feeds 300, 301 for first and second RF spectrally offset RF frequency bands. In particular these can include a lower frequency band serviced by RF feed 300 and a higher frequency band serviced by RF feed 301. First and second RF feeds 300, 301 can be circular profile waveguides having a coaxial configuration. Further each of the first and second RF feeds can have a respective corresponding sub-reflector for communicating RF energy between each of the RF feeds 300, 301 and their respective main reflectors 304, 306. Specifically a first sub-reflector 302 is provided for first RF feed 300 and a second sub-reflector 303 is provided for the second RF feed 301.

The first subreflector 302 and RF feed 300 can be arranged similarly to the (coupled) backfire feed system shown in FIG. 2. In particular, the first subreflector 302 and RF feed 300 can be spaced one to two wavelengths apart so as to comprise essentially a single backfire feed network. The first sub-reflector 302 and the RF feed 300 provide the feed system for a low frequency band of the antenna.

In contrast, second subreflector 303 and second RF feed 301 are preferably arranged in a conventional decoupled ring-focus configuration, meaning that aperture 31 8 of the second RF feed 301 is spaced at least about four (4) wavelengths from vertex 320 of the second subreflector 303 at the low end of the designed operating frequency of the feed. The second RF feed 301 passes through a vertex region of the first subreflector 302 and is terminated some distance from the first sub-reflector 302 for feeding the second sub-reflector 303 on a higher frequency band of the dual band system. Notably, the focal ring for the second sub-reflector is preferably located outside the second main reflector aperture to avoid distortion of the antenna beam produced by the second main reflector. This is because optical designs tend to perform poorly when the focal-ring (ring-focus antenna) or focal point (conventional parabolic antennas) is located inside the main reflector aperture.

Referring again to FIG. 3, it can be seen that the first and second main reflectors 304, 306 at least partially overlap one another and can be substantially coincident at a point 308 closest to the RF packaging 310. In order to prevent first main reflector 304 from shielding the second main reflector 306, the first main reflector 304 can be formed from a frequency selective surface (FSS). Frequency selective surfaces are well known in the art and can be formed from one or more layers of various geometric patterns of wires or apertures that are usually defined on a dielectric substrate. The FSS used to form the first reflector 304 can be selected to reflect RF energy at the design frequency selected for the first subreflector and feed pair 300, 302, but pass RF energy at the design frequency selected for the second subreflector and RF feed pair 301, 303.

For example, if the first subreflector and RF feed pair 300, 302 are designed to operate at C-band and the second subreflector and feed pair 301, 303 are designed to operate at Ku-band, then the FSS can have a stop band at low frequencies including C-band, and a pass band for higher frequencies including Ku-band. A suitable break point for the FSS band stop filter in this case could be selected at 6.425 GHz to accommodate these filter characteristics at C-band and Ku-band. Higher frequencies associated with feed 301 can be transmitted through the first main reflector 304 and are instead reflected by second main reflector 306.

Figure 4:
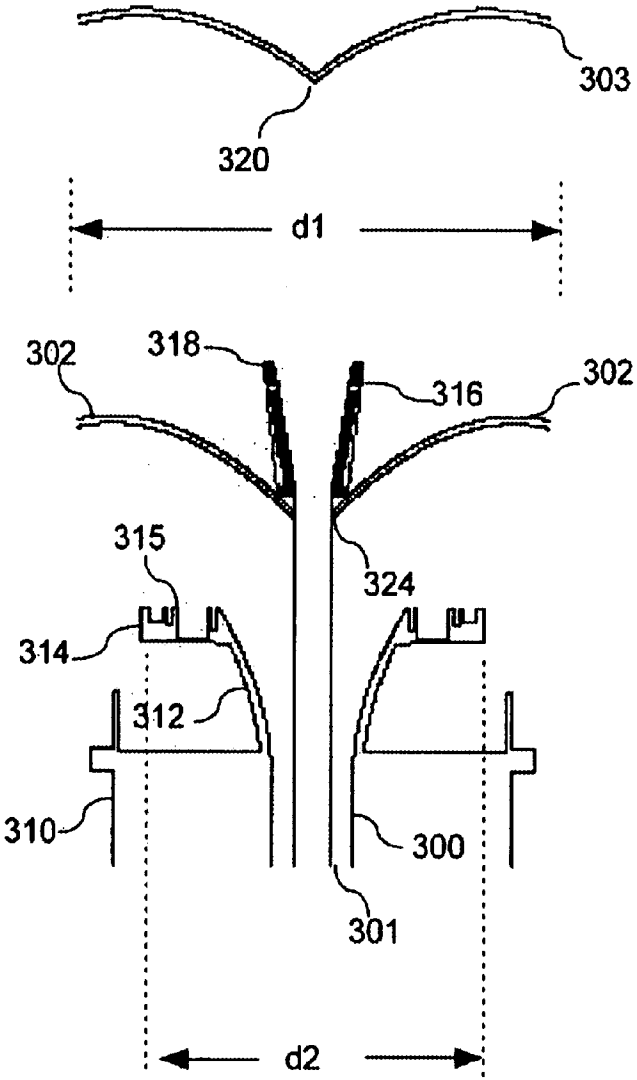
FIG. 4 is an enlarged view of the feed system in FIG. 3.

An enlarged view of the first and second subreflector and RF feed pairs is shown in FIG. 4. As illustrated therein, the RF feeds 300, 301 can be arranged coaxially about a boresight axis 322. RF energy can be communicated through each of said coaxially configured first and second RF feed elements 300, 301 as is known in the art.

First and second tapered horn sections 312, 316 can be provided for first and second RF feeds 300, 301. Horn 316 is preferably a conical type horn, it being understood that other horn profiles may also be adapted for use with the invention. Further, horn 316 can be selected to have an axial length and taper appropriate to improve impedance matching and beam shaping for meeting antenna selected performance specifications. Additional matching structure can be provided at the aperture 318 for controlling the gain factor and spillover efficiency if performance specifications so require. For example, conventional RF chokes (not shown) can be provided at the aperture 318 for this purpose. Similarly, horn 316 can have corrugations (not shown) formed along the axial length of the horn. Such corrugations are well known in the art for improving certain performance characteristics of the horn. The specific length taper, wall features and other characteristics of the horn 316 can be optimized using conventional computer modeling techniques.

Horn 312 is also preferably a conical horn, it being understood that other horn profiles may also be adapted for use with the invention. The horn 312 is preferably positioned so that the aperture 314 of the first RF feed and the vertex 324 of the sub-reflector 302 can be spaced apart by a distance that is less than about 2 wavelengths at the frequency of interest. When arranged in this way, the horn 312 and the sub-reflector 302 are said to be coupled in the near-field to produce a "back-fire" feed as described above in relation to FIG. 2.

As shown in FIG. 4, the diameter of the focal ring of the first main reflector 304 and the diameter of the first sub-reflector 302 at the aperture are advantageously selected to be about the same size. Further, the diameter of the subreflector 302 is preferably not much larger than the diameter of RF horn 312 at the aperture 314. In the back-fire feed configuration, the RF feed horn 312 and the sub-reflector 302 in combination can be considered as forming a single integrated feed network that provides a circular to radial waveguide transition. The circular to radial waveguide transition section includes the horn 312 and the sub-reflector 302.

The integrated feed network generates a prime-ring-focus type feed for the main reflector 304 that is similar to a prime-focus parabolic feed. The sub-reflector 302 in this feed configuration is not truly operating as a reflector in the conventional sense but rather as a splash-plate directly interacting with the feed horn 312 and aperture 314. As shown in FIG. 4 additional matching structure 315 can be provided at the aperture of the horn. The matching structure is typically a choke ring or rings of a number, width, and depth determined through an iterative computer modeling process where the cost function is one or more of the following:

a. improved antenna pattern performance with respect to sidelobes;

b. improved directivity; and c. improved return loss.

The RF feed 300, horn 312, matching structure 315 and sub-reflector 302 can together form a single integrated coupled feed for illuminating the first main reflector 304 with RF at the lower one of the frequency- bands. The shape of the first sub-reflector 302, the taper and aperture features of horn 312, and the shape of main reflector 304 can be selected using conventional computer modeling techniques.

In general, the shaped surfaces of the main reflectors 304, 306 and their respective sub-reflectors 302, 303 can be defined by an equation of a regular conic, such as a parabola or an ellipse. Alternatively, the shaped surfaces can be generated by executing a computer program that solves a prescribed set of equations for certain pre-defined constraints. For example, using techniques similar to those disclosed in Durham et al., each of the first and second sub-reflectors 302, 303 and the main reflectors 304, 306 can be advantageously shaped using computer modeling to achieve a desired set of antenna beam performance parameters.

According to a preferred embodiment, the precise shape of the first and second main reflectors 304, 306 and the first and second sub-reflectors 302, 303 can be determined based upon such a computer analysis. Given the prescribed positions of the apertures 314, 318 for RF feeds 300, 301 and boundary conditions for the antenna, the shape of the sub-reflectors 302, 303 and the main reflectors 304, 306 are generated by executing a computer program that solves a prescribed set of equations for the predefined constraints. Physical constraints drive some of the boundary conditions, such as the size of the subreflector and the size of the main reflector. Electromagnetic constraints drive other boundary conditions. For example, if the electrical spacing of the phase center for RF feed horn 316 to subreflector 302 is less than about four wavelengths at the high frequency band, then the operation of the subreflector 302 will no longer behave optically. Similarly, if the second sub-reflector 303 is too close to the first subreflector 302, then the low band feed will block the line-of-site between the subreflector 303 and main reflector, causing the system not to work properly.

Given the foregoing constraints, equations are employed which: 1—achieve conservation of energy across the antenna aperture, 2—provide equal phase across the antenna aperture, and 3—obey Snell's law. Details regarding this process are disclosed in U.S. Pat. No. 6,211,834 to Durham et al.

For a given generated configuration of RF feeds 300, 301, horns 312, 316, a given set of shapes for the sub-reflectors 302, 303 and the main reflectors 304, 306 the performance of the antenna is analyzed by way of computer simulation. This analysis determines whether the generated antenna shapes will produce desired directivity and sidelobe characteristics. RF matching components are used to achieve the desired return loss.

If the design performance criteria are not initially satisfied, one or more of the equations' parameter constraints are iteratively adjusted, and the performance of the antenna is analyzed for the new set of shapes. This process can be iteratively repeated, as necessary until the shaped antenna sub-reflector shape and coupling configuration, and main reflector shape, meets the antenna's intended operational performance specification for each band. Each of the feed configurations, and the shapes for the subreflector and main reflector may be derived separately, as described above.

Figure 5:
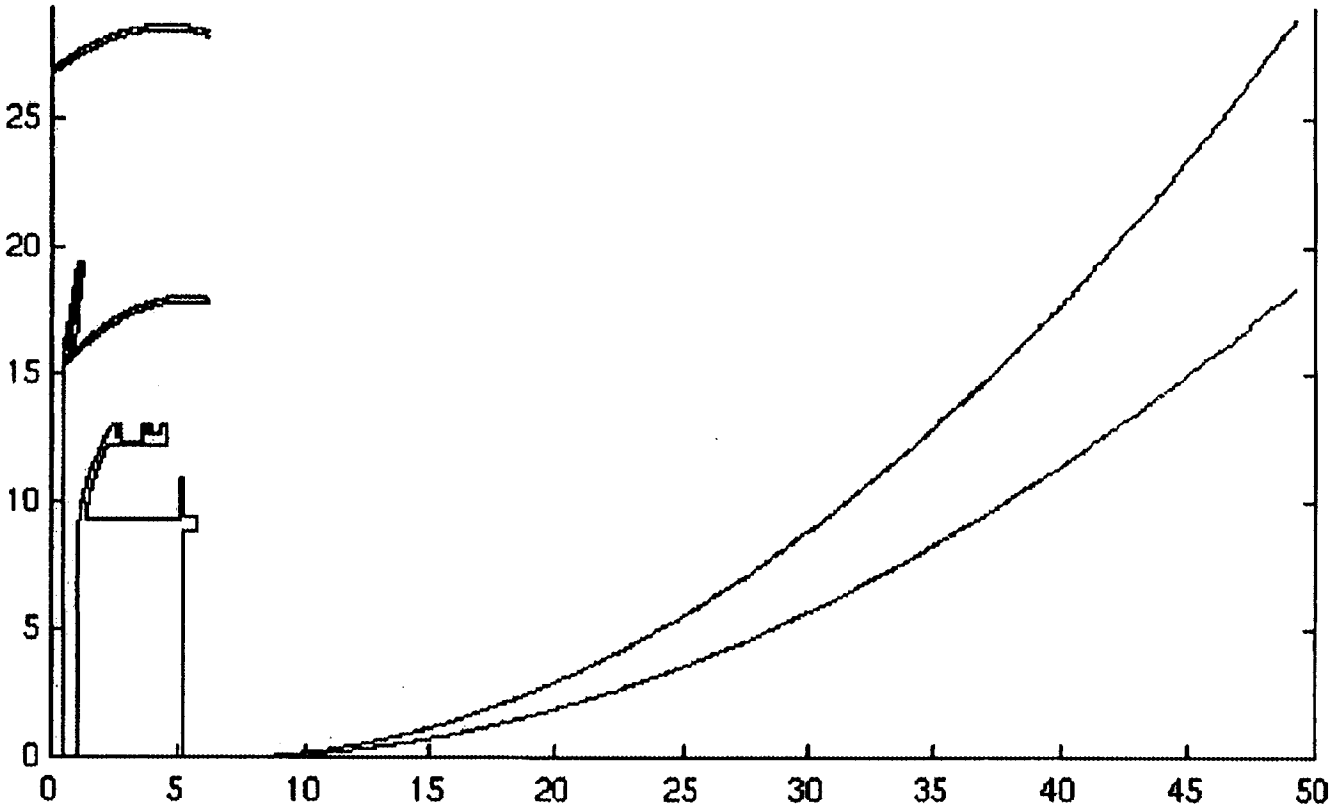
FIG. 5 is schematic representation of a dual band ring focus antenna that illustrates the compact nature of the antenna structure described in FIGS. 3 and 4.

FIG. 5 is schematic representation of a dual band ring focus antenna that illustrates the compact nature of the antenna structure described in FIGS. 3 and 4. The antenna system illustrated in FIG. 5, is designed for operation at C-band and Ku-band. It has a main reflector of 98.5 inches, and a pair of sub-reflectors that are each about 12.4 inches in diameter. The antenna achieves an equivalent focal ring distance (F/D) from vertex of main reflector (F) to diameter of main reflector (D) of 0.29. The antenna has an extremely small swept volume compared to other designs of equal performance. For example, equivalent performance from conventional Cassegrain/Gregorian co-located antenna designs would require substantially more volume.

Finally, it should be noted that while the antennas described herein have for convenience been largely described relative to a transmitting mode of operation, the invention is not intended to be so limited. Those skilled in the art will readily appreciate that the antennas can be used for receiving as well as transmitting.

We claim:

1. A compact multi-band ring-focus antenna system comprising:

a first and a second main reflector, each having a shaped surface of revolution about a common boresight axis of said antenna;

a first RF feed that is a backfire type system for feeding said first main reflector on a first frequency band;

a second RF feed coaxial with said first RF feed for feeding said second main reflector on a second frequency band spectrally offset from said first frequency band; and wherein a portion of said second RF feed passes through a first sub-reflector of said backfire feed, and said second RF feed is terminated a distance from said first sub-reflector to illuminate a second sub-reflector.

2. The compact multi-band ring-focus antenna system according to claim 1 wherein a vertex of said second sub-reflector is spaced along said boresight axis at least about four wavelengths from a vertex of said first sub-reflector.

3. The compact multi-band ring-focus antenna system according to claim 1 wherein at least a portion of said first main reflector is substantially co-located with said second main reflector.

4. The compact multi-band ring-focus antenna system according to claim 3 wherein said portion of said first main reflector is located at an inner periphery of said main reflector closest to said boresight axis.

5. The compact multi-band ring-focus antenna system according to claim 1 wherein said first main reflector is a frequency selective surface (FSS).

6. The compact multi-band ring-focus antenna system according to claim 1 wherein said backfire feed is comprised of a first horn closely coupled to and directly interacting with said first sub-reflector.

7. The compact multi-band ring-focus antenna system according to claim 6 wherein said first horn and said first sub-reflector comprise a circular to radial waveguide transition section of said backfire feed.

8. The compact multi-band ring-focus antenna system according to claim 1 wherein said second RF feed is decoupled from said second sub-reflector.

9. The compact multi-band ring-focus antenna system according to claim 1 further comprising a horn positioned on said second RF feed at a terminal end thereof opposed to said second sub-reflector.

10. The compact multi-band ring-focus antenna system according to claim 1 wherein at least one of said first and second main reflector has no continuous surface portion thereof shaped as a regular conical surface of revolution.

11. The compact multi-band ring-focus antenna system according to claim 1 wherein at least one of said first and second sub-reflector has no continuous surface portion thereof shaped as a regular conical surface of revolution.

12. The compact multi-band antenna system according to claim 1 wherein said first one of said frequency bands is C-band and said second one of said frequency bands is Ku-band.

13. A compact multi-band ring-focus antenna system comprising:

a first and a second main reflector, each having a shaped surface of revolution about a common boresight axis of said antenna, at least a portion of said first main reflector substantially co-located with said second main reflector and said first main reflector formed of a frequency selective surface (FSS);

a first RF feed that is a backfire type system for feeding said first main reflector on a first frequency band;

a second RF feed coaxial with said first RF feed for feeding said second main reflector on a second frequency band spectrally offset from said first frequency band; and wherein a portion of said second RF feed passes through a first sub-reflector of said backfire feed, and said second RF feed is terminated a distance from said first sub-reflector to illuminate a second sub-reflector.

14. The compact multi-band ring-focus antenna system according to claim 13 wherein said backfire feed is comprised of a first horn closely spaced from said first sub-reflector and directly coupled thereto.

15. The compact multi-band ring-focus antenna system according to claim 14 wherein said first horn and said first sub-reflector comprise a circular to radial waveguide transition section of said backfire feed.

16. The compact multi-band ring-focus antenna system according to claim 13 wherein said second RF feed is decoupled from said second sub-reflector.

17. A compact multi-band ring-focus antenna system comprising:

a first and a second main reflector, each having a shaped surface of revolution about a common boresight axis of said antenna;

a first RF feed for feeding said first main reflector on a first frequency band, said first RF feed comprised of a first RF feed horn closely spaced from and coupled to a first sub-reflector to comprise a circular to radial waveguide transition;

a second RF feed coaxial with said first RF feed for feeding said second main reflector on a second frequency band spectrally offset from said first frequency band; and wherein a portion of said second RF feed passes through said first sub-reflector, and said second RF feed is terminated a distance from said first sub-reflector to illuminate a second sub-reflector.

18. The compact multi-band ring-focus antenna system according to claim 17 wherein at least portion of said first main reflector is substantially co-located with said second main reflector.

19. The compact multi-band ring-focus antenna system according to claim 18 wherein said portion of said first main reflector is located at an inner periphery of said main reflector closest to said boresight axis.

20. The compact multi-band ring-focus antenna system according to claim 17 wherein said first main reflector is a frequency selective surface (FSS).

* * * * *